United States Patent [19]

Potter

[11] 4,393,100

[45] Jul. 12, 1983

[54] METHOD OF COATING A FUSED SILICA ENVELOPE

[75] Inventor: Ralph M. Potter, Pepper Pike, Ohio

[73] Assignee: General Electric Company, Schenectady, N.Y.

[21] Appl. No.: 295,462

[22] Filed: Aug. 24, 1981

Related U.S. Application Data

[62] Division of Ser. No. 107,253, Dec. 26, 1979, Pat. No. 4,339,686.

[51] Int. Cl.[3] ..... B05D 5/12

[52] U.S. Cl. ..... 427/181; 427/106; 427/215; 427/230; 427/245; 427/376.1; 427/376.2

[58] Field of Search ..... 313/221; 427/106, 314, 427/26, 215, 219, 230, 181, 245, 376.1, 376.2; 65/30.1, 60.1

[56] References Cited

U.S. PATENT DOCUMENTS

| | | | |
|---|---|---|---|
| 3,219,868 | 11/1965 | Mason | 313/221 |
| 3,377,498 | 4/1968 | Koury et al. | 313/221 |
| 3,845,343 | 10/1974 | Hammes | 313/221 |
| 3,851,200 | 11/1974 | Thomasson | 313/221 |
| 4,081,709 | 3/1978 | Collins et al. | 427/106 |
| 4,081,714 | 3/1978 | Mossel et al. | 427/106 |
| 4,091,163 | 5/1978 | Clausen | 427/106 |
| 4,099,080 | 7/1978 | Dawson | 427/106 |
| 4,256,988 | 3/1981 | Coaton | 313/221 |

*Primary Examiner*—Norman Morgenstern
*Assistant Examiner*—Richard Bueker
*Attorney, Agent, or Firm*—John P. McMahon; Philip L. Schlamp; Fred Jacob

[57] ABSTRACT

The coating on the inside of a metal halide lamp for promoting the formation of a liquid condensate film consists of particles of a refractory oxide in generally block-like or spherical or fiber-like shapes. Block-like or spherical particles should be laid down as monolayers with the distances between particles being of the order of the particle dimensions. Fiber-like particles may be also laid down as a monolayer or, alternatively, in a coating several diameters thick to form "fiber piles" having a free volume for holding liquid which is much greater than the volume of the fibers.

1 Claim, 7 Drawing Figures

METHOD OF COATING A FUSED SILICA ENVELOPE

This is a division of application Ser. No. 107,253, filed Dec. 26, 1979, now U.S. Pat. No. 4,339,686.

The invention relates to high intensity metal vapor discharge lamps which operate with an unvaporized excess of metal, and more particularly to metal halide lamps containing an excess of metal halide in liquid form. Copending application Ser. No. 105,588 filed Dec. 20, 1979, by Bateman et al and owned by the present assignee, discloses means for promoting the formation and spreading of a liquid condensate film on the interior surface of the envelope in such lamps. The present invention discloses an improvement in the type of coating which may be used for such purpose.

BACKGROUND OF THE INVENTION

Metal halide lamps began with the addition of the halides of various light-emitting metals to the high pressure memory lamp in order to modify its color and increase its operating efficacy as proposed by U.S. Pat. No. 3,234,421—Reiling, issued in 1966. Since then metal halide lamps have become commercially useful for general illumination; their construction and mode of operation are described in IES Lighting Handbook, 5th Edition, 1972, published by the Illuminating Engineering Society, pages 8–34.

The metal halide lamp generally operates with a substantially fully vaporized charge of mercury and an unvaporized excess consisting mostly of metal iodides in liquid form. The favored filling comprises the iodides of sodium, scandium and thorium. The operating conditions together with the geometrical design of the lamp envelope must provide sufficiently high temperatures, particularly in the ends, to vaporize a substantial quantity of the iodides, especially of the NaI. In general, this requires minimum temperatures under operating conditions of the order of 700° C.

The quantity of a metal salt which may be accommodated in the vapor state within a given volume at a given temperature, for instance NaI at 750° C., can be readily calculated. However, the metal salt charge, and in particular the charge of NaI, that is put into metal halide lamps of commercial manufacture is usually many times greater than such calculated quantity. While most of the added NaI remains as condensate within the arc tube, the quantity participating in the arc discharge does increase with the total quantity put into the tube, even though at a diminishing rate, and serves to improve the efficacy and lower the color temperature of the lamp.

The desirability of having the excess metal halide widely distributed rather than condensed in the ends of the lamp is known. To achieve this result, it has been proposed to design the arc tube in such a way that the end temperatures are higher than that in the middle, so that excess metal iodide will tend to condense about the middle of the arc tube. However in the usual quartz or fused silica arc tube, the condensate does not form a true film in the sense of a continuous layer on the inside surface of the envelope, but tends to remain as discrete droplets. In the aforementioned Bateman application, one means disclosed for promoting the formation and spreading of a liquid condensate film is a coating of fine particles of refractory material on the interior surface of the envelope. Such a coating may be formed by contacting the inside of the envelope by a silica smoke which is then partially sintered to compact it into a more rugged structure and improve its adherence. The coating provides a surface which causes the condensate to spread out into a film.

SUMMARY OF THE INVENTION

The object of the present invention is to provide within a metal vapor discharge lamp a coating which will hold more liquid condensate uniformly dispersed in a film on the interior surface of the envelope than possible up to now and which will interfere less with light transmission. The film of metal salt condensate is useful to increase efficacy and improve color rendition by getting the maximum effective quantity of metal salt such as halide and particularly NaI, in vapor form into the discharge. Another benefit from such a film is a filter effect which increases with the thickness of film and which can be used to lower the color temperature of the emitted light.

The coating on the inside of the arc tube is made up of particles of a refractory oxide, oxynitride, or nitride. While these particles may consist of single crystals or conglomerates of single crystals, I have found that (a) generally block-like or spherical shapes, and (b) fiber-like shapes, i.e. configurations wherein one dimension is several times the other dimensions, are preferable. Furthermore, I have discovered that for best results, special modes of application should be used depending upon the shapes and sizes of the particles selected, and the kind of coating, i.e. its structural nature and characterizing features, will vary accordingly.

Block-like or spherical particles should be laid down as monolayers with the distances between particles being of the order of the particle dimensions. Fiber-like particles may be laid down as a monolayer, in similar fashion to block-like particles. Alternatively, fiber-like particles may be laid down as a relatively thick coating, several particle diameters thick. In such case a fiber-like shape is preferred because the fibers tend to form "fiber piles" (by analogy to brush piles) having a free volume for holding liquid which is much greater than the volume of the fibers.

DETAILED DESCRIPTION

Figure 1:
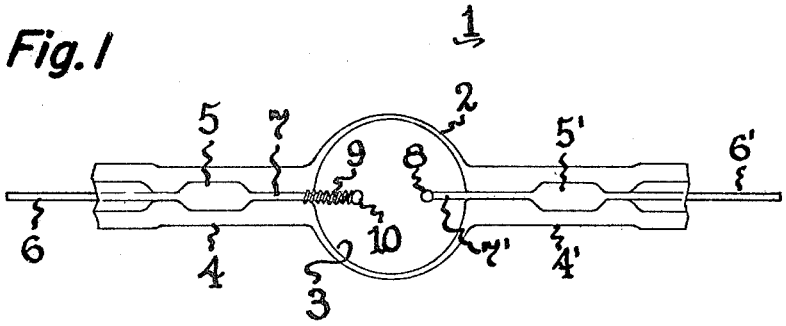
FIG. 1 shows a miniature metal halide arc lamp embodying the invention.

A miniature arc tube 1 whose central bulb portion 2 may be provided with an internal coating 3 according to my invention is shown in FIG. 1. The arc tube may be of the kind disclosed in U.S. Pat. No. 4,161,672—Cap et al, July 1979, utilizing thin-walled fused silica envelopes with small end seals to assure high efficacy in discharge volumes of one cubic centimeter or less. Such miniature arc tubes are particularly useful as the principal light source in lighting units designed for functional similarity to an incandescent lamp. A low color temperature matching that of the incandescent lamp is particularly desirable in this application and is readily achieved with the coatings of my invention.

According to my invention, coatings of particles of refractory metal oxides, oxynitrides or nitrides in block-like or spherical shapes are preferentially laid down as monolayers with substantial open space between particles and with the distance between particles not exceeding about 5 times the least dimension of the average particle. In this configuration, surface forces result in a rapid flow of liquid metal halides over the surface of the arc tube. With the particles forming substantially a monolayer, light scattering is minimized and light from the arc readily escapes the arc tube. The amount of optical filtering achieved can be controlled by varying the particle size: with mean particle size varied from, say, 1$\mu$ (micron) to 20$\mu$, the thickness of the liquid metal halide film will vary by a fairly large factor. Film thickness will also depend on details of particle shape and arrangement.

I have found that when block-like particles with diameters of about 20$\mu$ or less are introduced into a fused silica arc tube, they will readily adhere to the silica surface, provided it is clean, as a monolayer with interparticle separations of the order of particle dimensions. Firing an arc tube above red heat, or about 900° C., will assure a clean surface. The surface forces which result in this adherence are at least partly electrostatic; therefore the arc tubes and the powder should be reasonably dry and non-conducting to prevent the electric charge from leaking off too quickly.

After any excess particles have been removed from within the arc tube, a permanent bond between the adherent particles and the arc tube surface is achieved by heating the arc tube to an elevated temperature sufficient to cause some strong physical or chemical interaction to take place between the silica wall and the particles of the coating. The bond may result from fusing of the silica at the surface or from a reaction resulting in formation of a mixed phase. For instance $Al_2O_3$ will form a mullite (aluminum silicate) phase at the contact or interface between $Al_2O_3$ particles and a silica wall by heating for a very short time to near the softening temperature of the silica.

Figure 6:
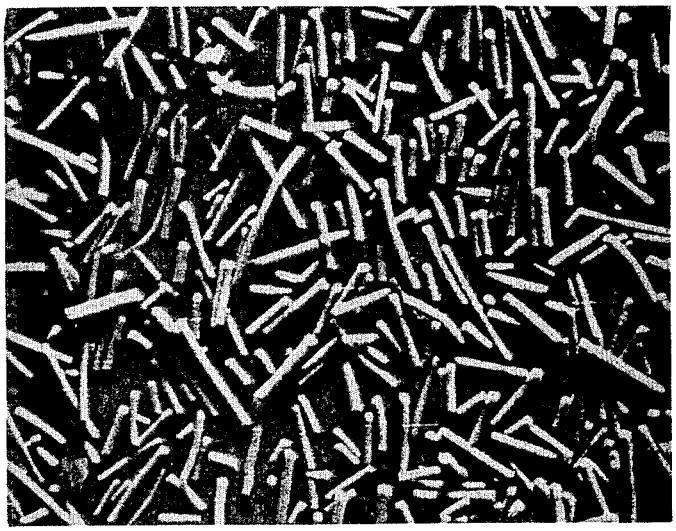
FIG. 6 is a photograph showing a 600 fold enlargement of a monolayer coating made of short fiber-like particles on a bulb fragment.

A monolayer of fiber-like particles can be applied to an arc tube by a process essentially identical to that described above for block-like particles. FIG. 6 illustrates the type of coating that can be obtained with fibers whose length averages in the range of 5 to 10 fiber diameters. The mean fiber diameter in the photograph is about 3$\mu$. Lamps made with these coatings have exhibited excellent efficiencies, and can be operated in either a vertical or a horizontal position. Similar lamps without coatings when operated in a horizontal position exhibit low efficiency because of inefficient vaporization of the metal iodides.

Figure 5:
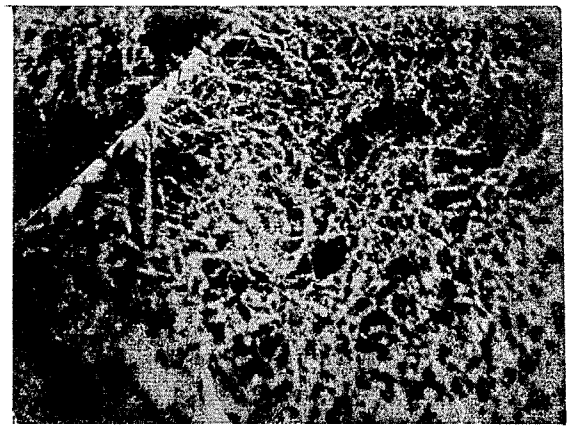
FIG. 5 is a photograph showing a 30 fold enlargement of a thick fibrous coating on a bulb fragment.
Figure 7:
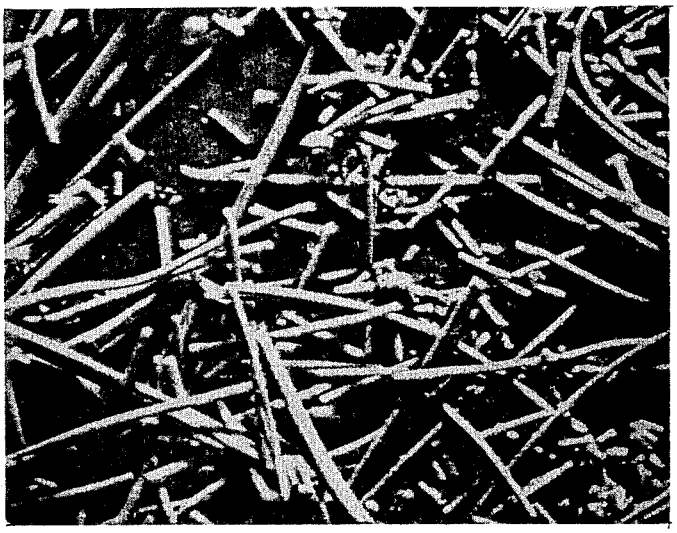
FIG. 7 is a photograph showing 600 fold enlargement of a thick fibrous coating on a bulb fragment.

I have also prepared coatings which are relatively thick, i.e. several particle diameters thick. In this case, a fiber-like shape is preferred because the fibers tend to form "fiber piles", that is open structures somewhat like brush piles, with a free volume for holding liquid metal halides which is much greater than the volume of the fibers. Such open structures, illustrated in FIGS. 5 and 7 also allow light from the arc to escape the arc tube with minimal scattering and consequent absorption. By contrast, thicker coatings of block-like or spherical particles are highly scattering, and reflect much of the light from the arc, resulting in increased absorption and lowered efficiencies.

To achieve the thicker fibrous coatings, means are needed to cause the fibers to adhere to themselves as well as to the silica wall. This can be accomplished by admixing with the fibers an ultrafine, reactive powder which sinters or melts when strongly heated and cements the fibers together wherever they contact each other. A brush-pile coating 3 may be applied to the interior of the bulb as follows:

1. A suitable fibrous aluminum oxide consisting of 95% $Al_2O_3$ and 5% $SiO_2$ with filament diameters of about 3 micron may be obtained from ICI Americas, Inc. under the designation "Saffil". The material is wetted with an ammoniacal solution containing about 5% by volume of "Ludox", a colloidal suspension of silica in water, and dried at about 110° C. "Ludox" may be obtained from Grasselli Chemical Division of E. I. Dupont & Co.
2. The dry material which at this stage consists of relatively long and flexible fine hairlike fibers is rubbed through a number 40 sieve (opening size 425 microns) to break up the fibers into shorter lengths. By way of example, the fiber lengths should now not be in excess of about 100 times the fiber diameter.
3. The material is then mulled into a viscous binder solution. The binder is eventually vaporized and expelled so that the choice is not critical; I have used nitrocellulose in amyl acetate and found it quite satisfactory.
4. A small quantity of the suspension is delivered into the unsealed bulb 2 of a miniature arc tube as illustrated in FIG. 1, and the bulb is rotated while blowing through it a gentle current of nitrogen or other dry gas suitable for vaporizing the solvent in the binder. In order to get an even coating, the bulb may be tipped alternately one way and the other while rotating until all the solvent is gone.
5. The binder is then lehred out by moderate heating of the bulb, and undesired coating is removed from the stem or neck regions. For this purpose a pipe cleaner may be used as a brush.
6. Finally, the bulb is strongly heated for instance through the use of an oxyhydrogen torch to (a) fuse the silica coating on the alumina fibers and thereby bind the fibers to each other, and (b) cause the alumina fibers to adhere to the bulb wall by chemical reaction.

When the silica from the Ludox coating on the alumina fibers is fused during the strong heating, some of it will tend by capillarity to seek points of intersection of the alumina fibers, and upon cooling serves to bind the fiber piles together. The silica coating on the alumina fibers thus has an important function as a glue to permit building up a relatively thick coating which is stable during handling and operation of the lamp. Without it, only a thin layer of alumina fibers which touch the wall are permanently bound to the wall. Where the alumina fibers touch the wall, adherence is believed to take place as a result of a chemical reaction between the $Al_2O_3$ of the fibers and the $SiO_2$ of the wall in which mullite or aluminum silicate is formed.

After the strong heating, the bulb coating adheres very tenaciously. The second portion of step 5 consisted in removing undesired fiber coating from the stem or neck regions of the bulb with a pipe cleaner. As an alternative, this portion of step 5 may be omitted, and after the strong heating of the bulb, fiber coating in the stem regions removed by a burst of nitrogen gas. The fiber pile coating when properly fired is unaffected by this process.

In the completed lamp shown in FIG. 1, the seals are made by collapsing through heat softening, assisted by vacuum if desired, the quartz of the necks 4,4' upon the molybdenum foil portions 5,5' of the electrode inlead assemblies. Leads 6,6' welded to the foils project externally of the necks while electrode shanks 7,7' welded to the opposite sides of the foils extend through the necks into the bulb portion. The lamp is intended for unidirectional current operation and the shank 7' terminated by a balled end 8 suffices for an anode. The cathode comprises a hollow tungsten helix 9 spudded on the end of shank 7 and terminating at its distal end in a mass or cap 10 which may be formed by melting back a few turns of the helix.

A typical miniature metal halide arc tube intended for a lamp of 35 watt size may have a bulb diameter of about 0.7 cm and a discharge volume of about 0.1 to 0.15 cubic centimeter. A suitable filling for the envelope comprises argon or other inert gas at a pressure of several tens of torr to serve as a starting gas, and a charge comprising mercury and the metal halides NaI, $ScI_3$ and $ThI_4$. The charge may be introduced into the arc chamber through one of the necks before sealing in the second electrode. The illustrated arc tube is usually mounted within an outer protective envelope or jacket (not shown) having a base or contact terminals to which the inleads 6,6' are connected.

Figure 4:
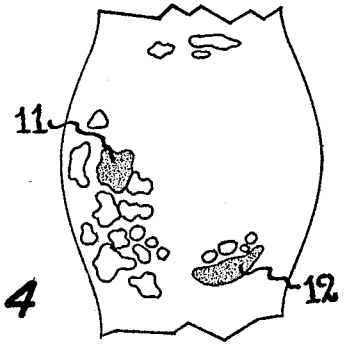
FIG. 4 is a sketch outlining the principal features in the photograph of FIG. 2.
Figure 2:
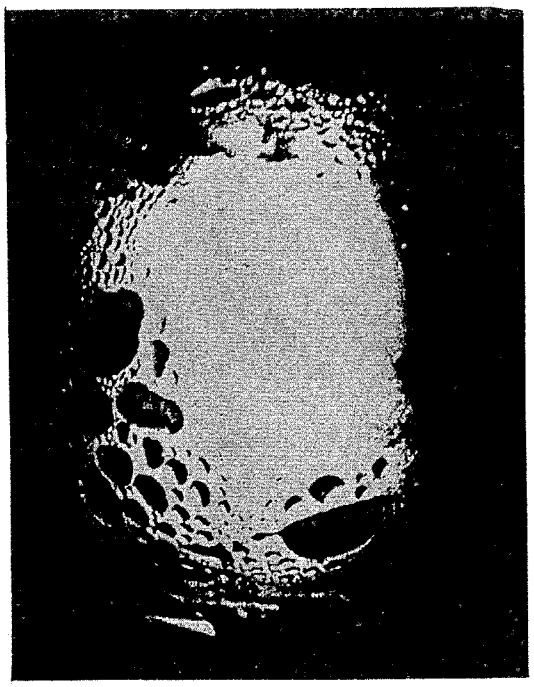

The brush-pile layer 3 in the bulb will spread the entire liquid dose or condensate into a substantially continuous film. FIGS. 2 and 4 are photographs of the images produced on a screen by focusing the light from the operating lamps thereon through a converging lens. In FIG. 2 where no layer is present, the condensate does not form a continuous film but instead forms discrete droplets which tend to persist. Some droplets become larger, for instance droplets 11 and 12 indicated in FIG. 4, as more condensate joins the mass. Eventually, the weight of a large droplet may cause it to roll down the wall into the end of the bulb. Sudden vaporization of the droplet should it touch the hot shank of the electrode may cause a reddish flash, and movement of the droplets causes some flickering of the light output from the lamp.

Figure 3:
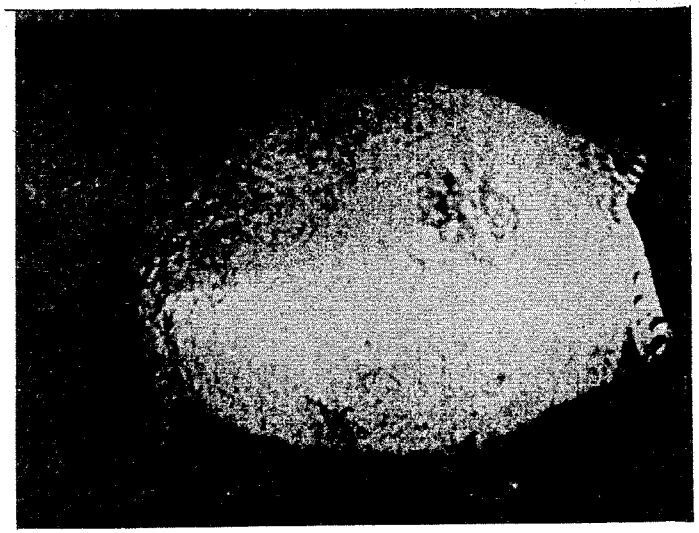
FIGS. 2 and 3 are enlarged photographs of miniature metal halide arc lamps under operating conditions, the former without and the latter with a fiber-pile coating according to the invention.

In FIG. 3 where a thick fiber-pile coating embodying the invention has been provided, a continuous film of condensate is present covering substantially the entire interior surface of the bulb. The large droplets of condensate are dispersed in the film. The film produces improved vaporization of the dose which results in the desired lower color temperature. Also the film of evenly dispersed halide, particularly NaI, serves as a color-correcting filter allowing further lowering of the color temperature. The thick fiber pile coating is so effective in maintaining a continuous film of condensate that the arc tube may be operated horizontally, that is electrode axis horizontal, without rupture of the film, even immediately above the arc.

What I claim as new and desire to secure by Letters Patent of the United States is:

1. A method of applying a coating of fiber like shaped particles selected from the group consisting of refractory metal oxides, oxynitrides, and nitrides or mixtures thereof to the interior surface of a fused silica envelope comprising:

an initial heating of said envelope above red heat to assure surface cleanliness and dryness;

coating a quantity of said film like shaped particles with an ultrafine, reactive powder that sinters or melts when strongly heated;

mulling said coated fiber like shaped particles into a viscous solution having a solvent and a solute wherein said solute is an acceptable binder, said mulling resulting in suspension of said coated fiber like shaped particles in said solution;

applying said suspension to said envelope interior;

vaporizing said solvent;

removing said binder by heating said envelope; and applying additional heat to said envelope to fuse said powder to said fiber like shaped particles and thereby bind said fiber like shaped particles to each other and cause adhesion of said fiber like shaped particles to said envelope.

* * * * *